US007404564B2

(12) United States Patent
Bregeon et al.

(10) Patent No.: US 7,404,564 B2
(45) Date of Patent: Jul. 29, 2008

(54) SNOW GLIDING BOARD WITH UPPER DECORATIVE AND PROTECTIVE ELEMENT

(75) Inventors: Vincent Bregeon, Voiron (FR); Max Mermet, Burcin (FR); Lionel Degasperi, Saint Etienne de Crossey (FR); David Bouvier, Grenoble (FR); Philippe Largeuze, Grenoble (FR); Benjamin Cuier, Villard de Lans (FR)

(73) Assignee: Skis Rossignol, Voiron (FR)

( * ) Notice: Subject to any disclaimer, the term of this patent is extended or adjusted under 35 U.S.C. 154(b) by 208 days.

(21) Appl. No.: 11/341,667

(22) Filed: Jan. 30, 2006

(65) Prior Publication Data

US 2006/0186618 A1 Aug. 24, 2006

(30) Foreign Application Priority Data

Feb. 23, 2005 (FR) ..... 05 50498

(51) Int. Cl.
*A63C 5/03* (2006.01)

(52) U.S. Cl. ..... 280/14.21; 280/602; 280/610; 280/609; 280/633; 280/611

(58) Field of Classification Search ..... 280/602, 280/610, 609, 633, 611, 634, 14.21
See application file for complete search history.

(56) References Cited

U.S. PATENT DOCUMENTS

| | | | | | |
|---|---|---|---|---|---|
| 4,697,820 | A | * | 10/1987 | Hayashi et al. | 280/609 |
| 5,016,901 | A | * | 5/1991 | Mayr | 280/607 |
| 5,042,829 | A | * | 8/1991 | Sedlmair | 280/633 |
| 5,143,394 | A | | 9/1992 | Piana | |
| 5,207,445 | A | * | 5/1993 | Hoelzl | 280/607 |
| 5,221,105 | A | * | 6/1993 | Mayr et al. | 280/633 |
| 5,855,389 | A | * | 1/1999 | Andrus et al. | 280/602 |
| 6,755,434 | B2 | * | 6/2004 | Deborde et al. | 280/602 |
| 2004/0217577 | A1 | | 11/2004 | Zanco | |
| 2004/0232594 | A1 | | 11/2004 | Chaumat et al. | |

FOREIGN PATENT DOCUMENTS

| | | | |
|---|---|---|---|
| DE | 39 33 717 | A1 | 4/1990 |
| EP | 1 479 416 | A | 11/2004 |
| EP | 1 484 090 | A | 12/2004 |
| FR | 2 540 391 | A | 8/1984 |
| FR | 2 616 340 | A | 12/1988 |

* cited by examiner

*Primary Examiner*—Christopher Ellis
*Assistant Examiner*—Cynthia F Collado
(74) *Attorney, Agent, or Firm*—Browdy and Neimark

(57) ABSTRACT

A snow gliding board (1) comprises, in particular, an upper surface consisting of an upper decorative and protective element (16) having a recess in which an insert (21, 22, 23) is fitted.

The insert (21, 22, 23) comprises at least one first part made of an elastomer material (24) juxtaposed on the upper surface with at least one second part made of a metallic material (26).

15 Claims, 2 Drawing Sheets

SNOW GLIDING BOARD WITH UPPER DECORATIVE AND PROTECTIVE ELEMENT

The present invention relates to a snow gliding board having an upper decorative and protective element with an additional vibration-damping function.

Snow gliding boards, i.e. alpine skis, snowboards, cross-country skis, monoskis, touring skis, ski blades, etc. are increasingly decorated in order to conceal the internal body or structure of these boards. An upper decorative and protective element provides a visual effect which is pleasant and attractive to the user and those in the user's vicinity. Besides its aesthetic effect, this element also plays a role in protecting the structure of the board against external stresses such as knocks from edges and impacts.

Besides its protective and decorative function, it is useful to give the upper element additional functions such as a ski carrier feature, a means to ensure that snow and ice do not stick to it, a means to ensure that it dampens vibrations throughout the board and other functions as well. These functions are obtained by separately mounting special components and/or vibration-damping materials.

The user is aware that the vibrational behaviour of his/her board is a factor that determines how enjoyable it is to use on snow. Board vibrations have an influence on holding a trajectory, the extent to which the edges bite into the snow surface and on the board's overall ride comfort. A board with excessive vibration damping becomes difficult to control, lacks accuracy and is sluggish; the transmission of the thrust exerted by the user becomes imprecise. Conversely, a board with inadequate vibration damping is too twitchy and tiring to control and soon becomes unpleasant to use. A compromise must therefore be struck between vibration damping and rigidity in order to transmit the thrust exerted by the user in order to guide the board.

DESCRIPTION OF THE PRIOR ART

Document FR-2.616.340 discloses a vibration-damping device for a ski which is embedded in a window made in the upper decorative and protective element. The window, including the vibration-damping device, is positioned in front of the ski binding. The vibration-damping device comprises a first layer of viscoelastic material placed against the internal structure of the ski and associated with an overlaid freely movable stress plate made of a metallic material which is flush with the upper surface of the ski. The vibration-damping device therefore limits vibration of the entire ski when the ski is in use.

However, such a device can only work properly in a vertical direction, from the upper surface of the ski to the base and vice versa. Because it is embedded into the window, the metal plate has very little freedom to move horizontally, i.e. in a manner which is substantially parallel to the upper surface of the ski. What is more, this vibration-damping device can only be used if it is located away from the area intended for the ski binding. It cannot significantly absorb shocks to which the user's boot is directly exposed.

Document U.S. Pat. No. 5,143,394 also describes a device intended to dampen the vibrations of a ski due to the effect of impact between bumps and the shovel and the tail. The device comprises one or more weights mounted in an opening and supported by a deformable membrane.

However, it is difficult for the user to appreciate the effectiveness of such a device because of the extremely large number of variables encountered in terms of the types of snow encountered and different styles of skiing. It is also complicated to set up, particularly expensive to produce and fragile in use.

SUMMARY OF THE INVENTION

The main problem which the invention aims to solve is to develop a gliding board that is both comfortable for the user thanks to the damping of vibrations but sufficiently responsive to allow the user to experience the sensation of controlling the board by precise transmission of thrust. A second problem is to produce a gliding board with a vibration-damping device which is incorporated in the upper decorative and protective element. Another problem is that of producing a board that includes a vibration-damping device that can be located anywhere on the upper surface, from the tail to the shovel, including the area where the binding is mounted.

The invention therefore relates to a snow gliding board of the type comprising:

- an upper surface consisting of an upper decorative and protective element, and
- an insert comprising at least one first part made of an elastomer material and at least one second part made of a metallic material.

In accordance with the present invention, the gliding board is characterised in that the insert is built into the upper decorative and protective element by being located in a recess made in said upper decorative and protective element, the first part and the second part being located in continuous alignment with the upper surface.

In other words, by joining two different materials side by side, the insert constitutes a vibration-damping device. The first part, the second part and thus the insert are substantially at the same level as the upper decorative and protective element. Because it is built into or embedded in the recess made in the upper decorative and protective element, the vibration-damping device acts in a plane that is substantially parallel to the surface of the board. This vibration-damping device therefore operates like a spring-loaded weight system located on the surface of the board.

One of the materials is mechanically rigid and the other material is elastic or viscoelastic. When the vibration-damping device is located under the binding, the elastic material attenuates the vibrations and the more rigid material allows direct transmission of the forces exerted by the user to the board. If the vibration-damping device is located in other areas of the board, the elastic material attenuates the vibrations transmitted to the more rigid material due to shocks sustained by the gliding board.

In a first advantageous embodiment, the recess and the insert can be arranged in the area where a binding, intended to attach the user's boot to the board, is mounted. The first part(s) made of an elastomer material can be preferably be positioned in the centre of the insert.

When the users wish to make a turn, they tilt the board onto the corresponding edge. To transmit thrust onto one of the two edges, the user's boot exerts a lateral thrust. Thanks to the second metal part(s), it will be possible to transmit this thrust directly from the boot to the right or left-hand edge in question. The first elastomer part(s) is/are used to dampen vibrations underneath the binding. The first elastomer part(s) can be surrounded on the upper surface by the second metal part(s).

In order to ensure additional strength to secure the binding to the board, the retaining screws that attach the binding to the board may pass through the second metal part(s). Two inserts can be provided on the board. A toe piece of the binding can usefully be attached to a first insert and a heel piece of the binding can usefully be attached to a second insert.

In a second advantageous embodiment, the recess and the insert can be located between an area where a binding intended to attach the user's boot to the board is mounted and a shovel area. The second metal part(s) can preferably be located in the centre of the insert.

The metal part(s) has/have a much higher mass and inertia than the elastomer part(s). In this way, the metal part(s) acts/act as a weight directly alongside the first elastomer part(s) which acts/act as a spring. The metal part(s) attenuate(s) the vibrations by moving in a substantially vertical direction at the surface of the gliding board. The second metal part(s) can be surrounded on the upper surface by the first elastomer part(s).

In an alternative embodiment, the second metal parts and the first elastomer parts can be of the same thickness. In another alternative, the second metal parts and the first elastomer parts can be of different thicknesses.

A board can be produced by using a first manufacturing method. The insert can then be inlaid or embedded in the upper element so as to form the recess. The insert can be flush with the upper surface of the board.

A board can be produced by using a second manufacturing method. The insert can be placed in a window that forms the recess previously cut out from the upper element. Leaktightness between the insert and the upper element can be ensured by a polymer barrier film having dimensions larger than those of the window. The polymer barrier film can be placed between the insert and an internal structure of the board and be capable of preventing infiltration of a component material of the internal structure of the board.

A board can be produced by using a third manufacturing method. The insert can be inlaid in the upper element so as to form the recess and have at least one means of anchoring. The one or more means of anchoring can pass through at least one opening previously made in the upper element and penetrate into the internal structure of the board.

BRIEF DESCRIPTION OF THE DRAWINGS

The invention and its various advantages and features will become more apparent from the following description given, merely by way of example, reference being made to the accompanying drawings in which.

DESCRIPTION OF THE PREFERRED EMBODIMENTS

Figure 1:
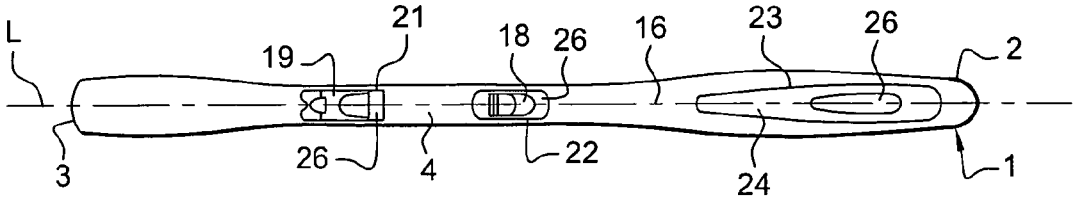
FIG. 1 shows a top view of a gliding board according to the invention together with its binding.

As shown in FIGS. 1, 2 and 6 to 8, a snow gliding board, for example an alpine ski (1), has a front area with a shovel (2), a rear area with a raised tail (3) and a central area referred to as the waist (4). The ski (1) comprises a lower surface that forms the base (6) bounded on either side by two side edges (7 and 8).

In a first embodiment (see FIGS. 6 to 8), known by the name "DUALTEC™", two lateral longitudinal reinforcing elements (9 and 11) are each fitted above the metal edges (7 and 8) and form partial lateral edges of the ski (1).

The ski (1) also comprises an internal structure (12) made, for example, by injecting two compounds which, after hardening, form rigid polyurethane. At the base of the internal structure (12), i.e. above the base (6), there is a first internal reinforcement (13). At the top of the internal structure (12) there is a second internal reinforcement (14).

The upper surface of the ski (1) is formed by an upper protective and decorative element (16). The upper decorative and protective element (16) is mounted on top of the second internal reinforcement (14). The upper decorative and protective element (16) consists, for example, of a mixture of styrene acrylonitrile (SAN) and thermoplastic polyurethane (TPU).

Two components of the binding (17), the toe piece (18) and the heel piece (19), are mounted on the waist (4) in order to attach the user's boot (not shown) to the ski (1).

According to the invention, the ski (1) together with its upper protective and decorative element (16), comprises three inserts (21, 22 and 23) which form three different vibration-damping devices respectively (see FIGS. 1 to 5). The three inserts (21, 22 and 23) are centred crosswise relative to the longitudinal centreline (L) of ski (1).

Figure 2:
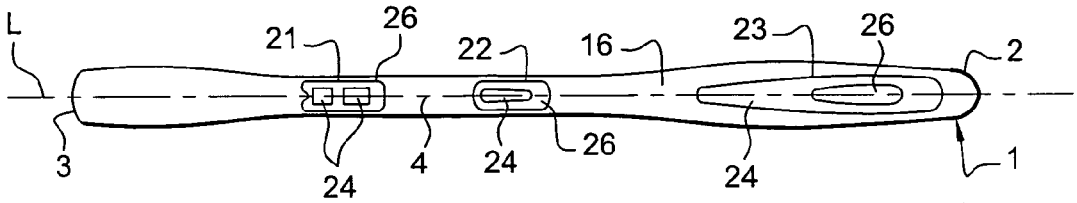
FIG. 2 shows a top view of the board in FIG. 1 without its binding.
Figure 3:
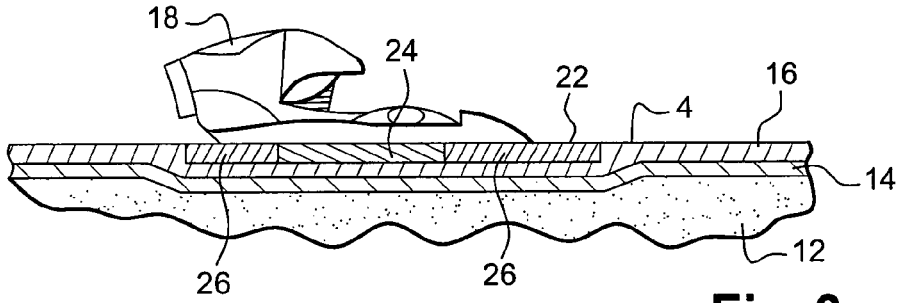
FIGS. 3 and 4 show partial vertical cross-sectional views along the longitudinal midline plane of the board in FIG. 2 in the area of the toe piece and the heel piece respectively.
Figure 4:
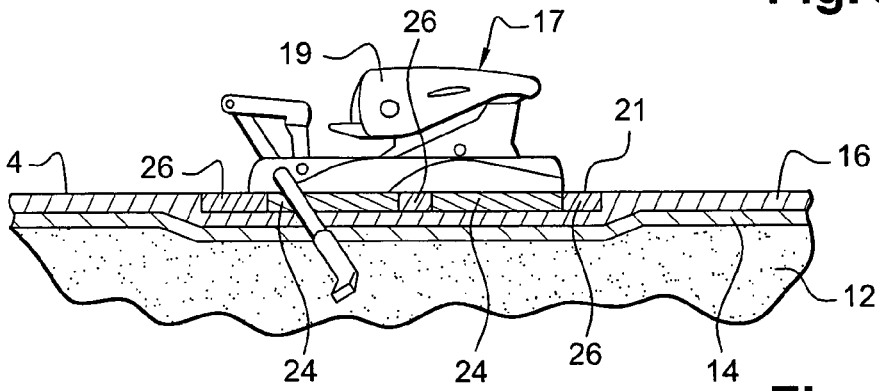
Figure 5:
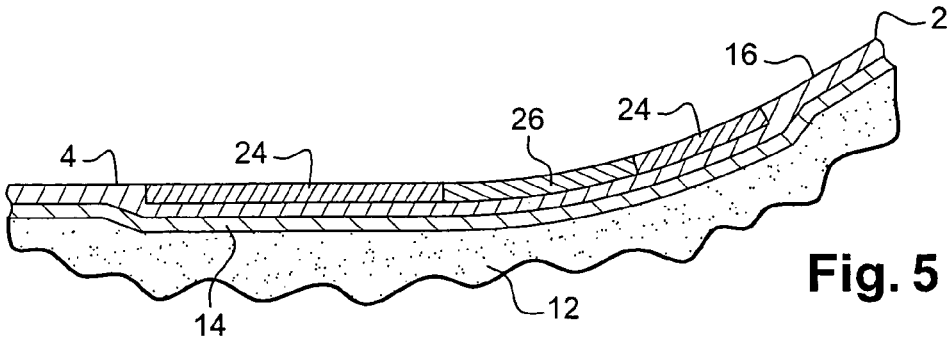
FIG. 5 shows a partial vertical cross-sectional view along the longitudinal midline plane of the board in FIG. 2 in the area of the shovel.
Figure 6:
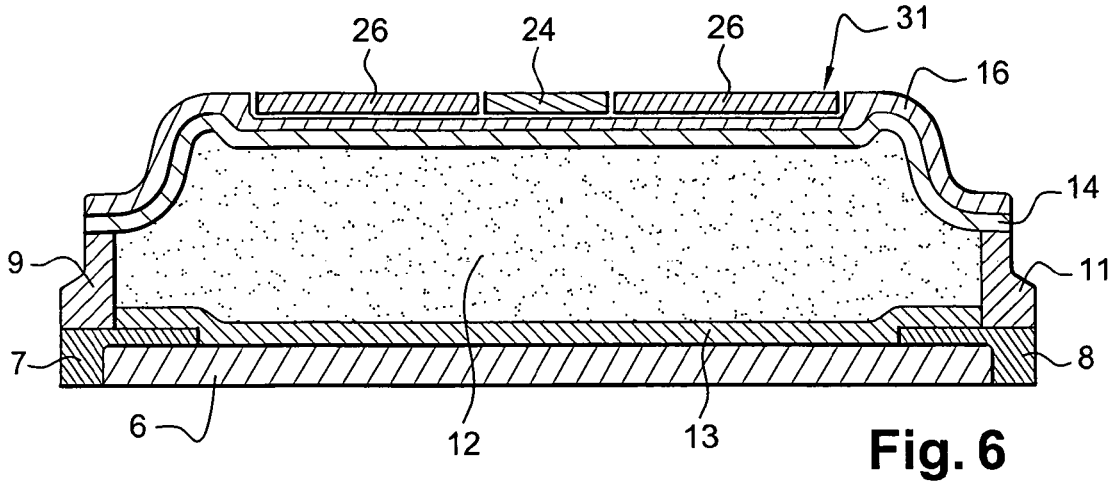
FIGS. 6 to 8 show vertical cross-sectional views of boards obtained using three different manufacturing methods respectively.
Figure 7:
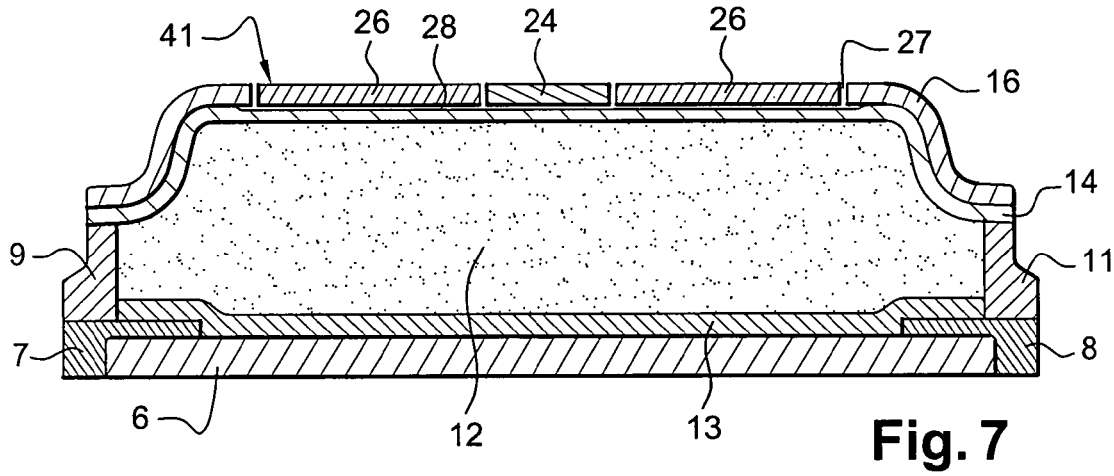
Figure 8:
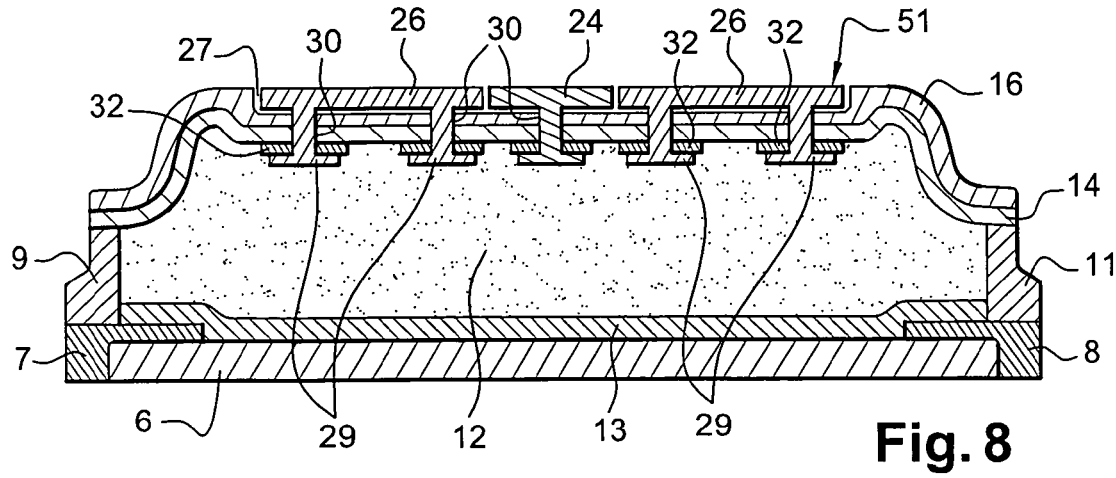

As is apparent in FIGS. 1, 2 and 4, the first insert (21) is located behind the waist (4). The heel piece (19) is basically positioned on this first insert (21) (see FIG. 4 more especially). As is apparent in FIGS. 1 to 3, the second insert (22) is located in front of the waist (4). The toe piece (18) is basically positioned on this second insert (22) (see FIG. 3 more especially). As is apparent in FIGS. 1, 2 and 5, the third insert (23) is located in front of the toe piece (18) closer to the shovel (2) than to the waist (4). Viewed from above, the third insert (23) has a basically oval shape.

In accordance with the present invention, the three inserts (21, 22 and 23) each comprise at least one first elastomer part fitted alongside and next to at least one second metal part on the upper decorative and protective element (16). The first part(s) and the second part(s) remain visible on the surface of the ski (1).

The first insert (21) comprises (FIGS. 2 and 4) two first elastomer parts (24) surrounded by a second metal part (26). The second insert (22) comprises (FIGS. 2 and 3) a first elastomer part (24) surrounded by a second metal part (26). Conversely, the third insert (23) comprises (FIGS. 2 and 5) a second metal part (26) surrounded by a first elastomer part (24).

All combinations of and variations in thicknesses are possible for the first elastomer parts (24) and second metal parts (26). The first elastomer parts (24) and/or the second metal parts (26) may protrude beyond, be depressed below or flush in alignment with the surface of the upper protective and decorative element (16).

In the case of the first insert (21) and second insert (22), the first elastomer parts (24) which are flexible dampen vibrations and prevent the transmission of vibrations from the waist (4) to the toe piece (18) and the heel piece (19). In the case of the first insert (21) and the second insert (22), the second metal parts (26) which are rigid facilitate the transmission of thrust forces from the skier's foot to the boot and then to the toe piece (18) and the heel piece (19) in the direction of the two side edges (7 and 8). The second metal parts (26) also facilitate the fitting of screws to attach the components of the binding (17), toe piece (18) and heel piece (19), into the internal structure (12) of the ski (1).

In the case of the third insert (23), the second metal part (26) acts as a counterweight surrounded by the first elastomer part (24). Vibrations are compensated by displacement in all directions located in a horizontal plane of the second metal part (26) in opposition to the first elastomer part (24).

The elastomer material of the first part(s) (24) can have a hardness equal to or less than 85 Shore A, preferably equal to 60 Shore A. The material also has a high damping coefficient in order to make the ski handle more comfortably on the snow. Merely by way of example, this elastomer material can be chosen from a group comprising, on their own or in a mixture, rubbers and thermoplastics based on styrene butadiene, polyurethanes and other materials.

Merely by way of example, the metallic material of the second part(s) (26) can be a strip chosen from the group comprising aluminium or aluminium alloys, stainless steel, titanium and other materials.

In a first manufacturing process, for example that described in Document EP-0.972.544, insert (31) is inlaid (see FIG. 6) in the upper decorative and protective element (16) so that it is flush with the upper surface of the ski (1). Before this, the first elastomer part (24) is fitted in the centre of the second metallic part (26) after making a cut-out in the latter.

In a second manufacturing process, for example that described in Document EP-1.247.550 (see FIG. 7), a window (27) is cut out of the upper decorative and protective element (16). The first elastomer part (24) is then fitted in the centre of the second metal part (26) after making a cut-out in the latter. A polymer film (28) having dimensions larger than those of the insert (41) is bonded underneath this insert (41). The film (28) and insert (41) assembly is then inserted into the window (27) of the upper element (16). The film (28) prevents leakage of any component material of the internal structure (12) during polymerisation.

In a third manufacturing process, for example that described in Document EP-1.479.416 (see FIG. 8), insert (51) is inlaid (see FIG. 8) in the upper decorative and protective element (16) so that it is flush with the upper surface of ski (1). The first elastomer part (24) and the second metal part (26) are equipped with anchoring features (29). These features (29) pass through the upper decorative and protective element (16) and the second internal reinforcement (14) through openings (30) and fit into the internal structure (12). A lockwasher (32) can prevent any detachment of the features (29) and prevents the first elastomer part (24) and the second metal part (26) from being pulled out.

The present invention is not confined to the embodiments described and shown. Many modifications can be envisaged without extending beyond the scope of the claims.

In a second example of a ski (not shown), the two longitudinal reinforcing elements are deployed over the entire height of the ski giving the latter a rectangular shape. In a third example of a ski (not shown), the upper protective and decorative element forms a shell which rests directly on the edges. The invention can be applied to these three typical embodiments, on their own or in combination, without any distinction.

The invention claimed is:

1. A snow gliding board of the type comprising:

an upper surface consisting of an upper decorative and protective element (16), and an insert (21, 22, 23) comprising at least one first part made of an elastomer material (24) and at least one second part made of a metallic material (26), characterised in that the insert (21, 22, 23) is built into the upper decorative and protective element (16) by being located in a recess made in said upper decorative and protective element (16), the first part (24) and the second part (26) being located in continuous alignment with the upper surface, and said first part of elastomeric material (24) being at said upper surface of said board.

2. A board as claimed in claim 1, characterised in that the recess and the insert (21) are located in the area (4) where a binding (17) intended to attach the user's boot to the board (1) is mounted.

3. A board as claimed in claim 1 or 2, characterised in that the first elastomer part(s) (24) are located in the centre of the insert (21) and are surrounded on the upper surface by the second metal part(s) (26).

4. A board as claimed in claim 2, characterised in that the screws that attach the binding (17) to the board (1) pass through the second metal part(s) (26).

5. A board as claimed in claim 3, characterised in that a toe piece (18) of the binding (17) is attached to a first insert (22) and a heel piece (19) of the binding (17) is attached to a second insert (21).

6. A board as claimed in claim 1, characterised in that the recess and the insert (23) are located between an area (4) where a binding (17) intended to attach the board user's boot is mounted and a shovel area (2).

7. A board as claimed in claim 6, characterised in that the second metal part(s) (26) is/are located in the centre of insert (23) and are surrounded on the upper surface by the first elastomer part(s) (24).

8. A board as claimed in claim 1, characterised in that the second metal parts and the first elastomer parts are of the same thickness.

9. A board as claimed in claim 1, characterised in that the second metal parts and the first elastomer parts are of different thicknesses.

10. A board as claimed in claim 1, characterised in that insert (31) is inlaid in upper element (16) so as to be flush with the upper surface of the board (1).

11. A board as claimed in claim 1, characterised in that the insert (41) is placed in a window (27) previously cut out of upper element (16), leaktightness between the insert (41) and the upper element (16) being ensured by a polymer barrier film (28) having dimensions larger than those of the window (27), placed between insert (41) and an internal structure (12) of board (1) and capable of preventing infiltration of a material that is a component of the internal structure (12) of the board (1).

12. A board as claimed in claim 1, characterised in that the insert (51) is inlaid in the upper element (16) and has at least one anchoring means (29) passing through at least one opening (30) previously made in the upper element (16), and penetrating into the internal structure (12) of the board (1).

13. A board as claimed in claim 3, characterised in that the screws that attach the binding (17) to the board (1) pass through the second metal part(s) (26).

14. A board as claimed in claim 4, characterised in that a toe piece (18) of the binding (17) is attached to a first insert (22) and a heel piece (19) of the binding (17) is attached to a second insert (21).

15. A snow gliding board comprising:

an upper surface consisting of an upper decorative and protective element (16), and an insert (21, 22, 23) comprising at least one first part made of an elastomer material (24) and at least one second part made of a metallic material (26), Wherein the insert (21, 22, 23) is built into the upper decorative and protective element (16) by being located in a recess in said upper decorative and protective element (16), the first part (24) and the second part (26) being located in substantially continuous alignment with the upper surface, wherein the recess and the insert (23) are located between an area (4) where a binding (17) is adapted to attach and a shovel area (2), wherein the second metal part (26) is located in the center of the insert (23) and is surrounded on the upper surface by the first elastomer part (24), and wherein the insert (31) is inlaid into the upper decorative and protective element (16) so as to be substantially flush with the upper surface of the board (1).

* * * * *